US005123484A

United States Patent [19]

Bode

[11] Patent Number: 5,123,484

[45] Date of Patent: Jun. 23, 1992

[54] PIPE HANDLING CLAMP

[76] Inventor: Robert E. Bode, 12500 Melville, No. 109A, Montgomery, Tex. 77356

[21] Appl. No.: 680,855

[22] Filed: Apr. 5, 1991

[51] Int. Cl.[5] ..... E21B 19/00

[52] U.S. Cl. ..... 166/85; 175/85

[58] Field of Search ..... 166/85, 77.5; 175/52, 175/85

[56] References Cited

U.S. PATENT DOCUMENTS

| | | | |
|---|---|---|---|
| 3,994,350 | 11/1976 | Smith et al. | 175/85 |
| 4,440,220 | 4/1984 | McArthur | 166/85 |
| 4,655,291 | 4/1987 | Cox | 166/85 X |
| 4,718,805 | 1/1988 | Becker | 175/85 X |

*Primary Examiner*—Thuy M. Bui

*Attorney, Agent, or Firm*—Dodge, Bush, Moseley & Riddle

[57] ABSTRACT

In accordance with an illustrative embodiment of the present invention, a clamp assembly that is tightened around a pipe to handle the same includes linked, circumferentially spaced gripping members open on one side to provide a gate region, a pressure operated piston and cylinder assembly that cooperates with a latch to close and open the gate region, and line connections to apply selected pressures to the opposite sides of the piston. A low level pneumatic pressure is applied to the outer side of the piston at all times and tends to open the clamp, and a high level of pressure is selectively applied to the opposite side of the piston to close the gate region. As the high pressure is bled off, the low pressure level automatically opens the gate region.

13 Claims, 1 Drawing Sheet

FIG. 1
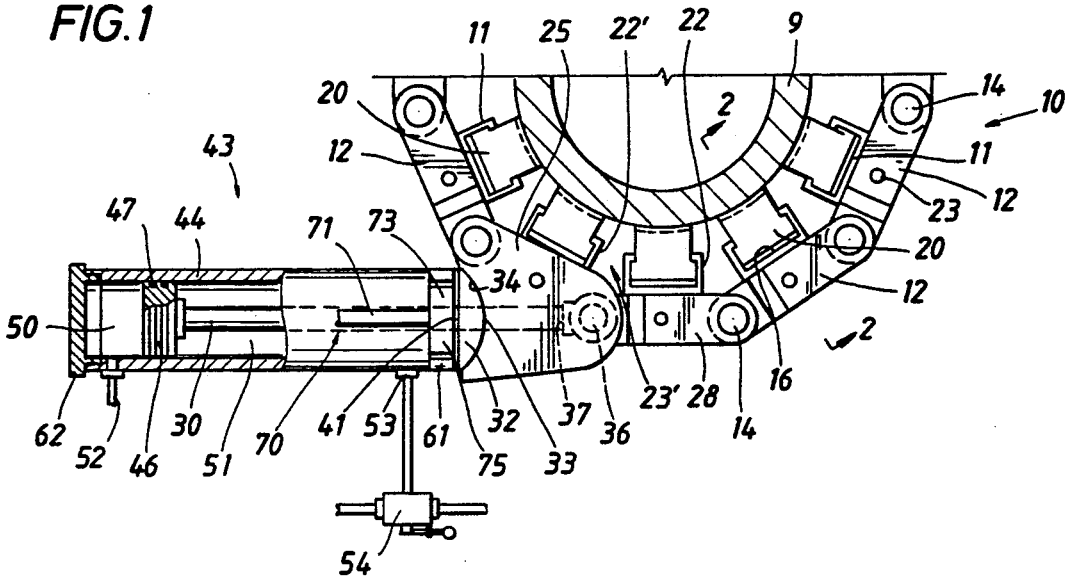
FIG. 2
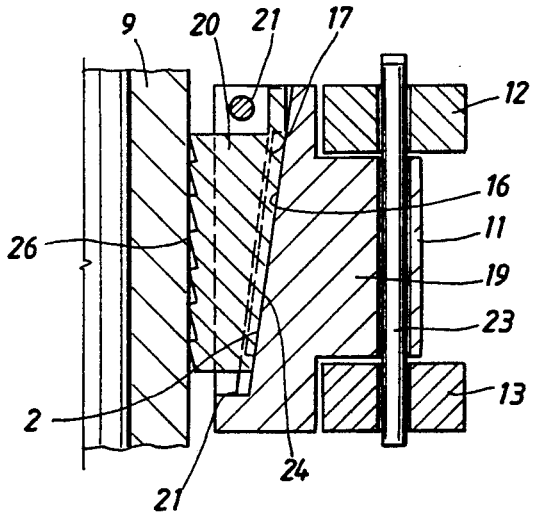
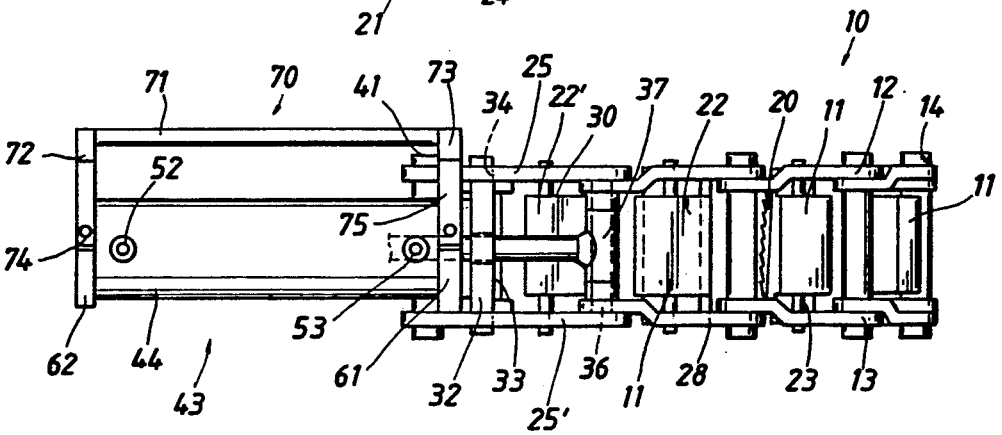
FIG. 3

PIPE HANDLING CLAMP

FIELD OF THE INVENTION

This invention relates generally to pipe handling devices, and particularly to a new and improved pressure actuated pipe clamp that is adapted to hold and support various types of pipe joints as they are being installed in a well.

BACKGROUND OF THE INVENTION

To handle tubular products such as flush joint pipe and drill collars at the floor of a drilling rig, a clamp apparatus is employed that provides one or more shoulders by which the pipe can be elevated and lowered. One mechanical device that has been used includes hinged slips which surround the pipe and grasp the same, and a latch structure providing a gate which is opened to position the clamp around the pipe and closed to lock the clamp in place. The latch structure includes a long bolt having a thrust washer slidable thereon so that it can be positioned against the arms of the latch, and an adjusting nut that is threaded on the outer end of the bolt adjacent the washer. After positioning the assembly of linked slips around the pipe, the gate is closed by pivoting the bolt to position the thrust washer and nut in alignment with the latch arms. Then the nut is tightened by hand using a large wrench, and a sledge hammer, to bring the washer up tightly against the latch arms to close the gate and create hoop stresses that cause the slips to grip the pipe. An example of this type of device is shown on p. 8426 of the "1982-83 Composite Catalog of Oilfield Equipment and Services" published by World Oil.

Although this device has been used for some time, there are many dangers inherent in hand operation of most any device that is used on a rig floor to handle heavy masses. If the gate is not properly closed, latched and tightened, the pipe can be dropped and cause serious injury, particularly to a worker who is near the area by virtue of having manually positioned and closed the clamp.

The general object of this invention is to provide a new and improved clamp apparatus for handling tubular products in a safe and reliable manner.

SUMMARY OF THE INVENTION

This and other objects are attained in accordance with the concepts of the present invention though the provision of a pipe handling clamp apparatus comprising a plurality of circumferentially spaced gripping members pivoted to one another and adapted to encircle and grip the pipe to prevent axial movement thereof. A pair of adjacent gripping members are not connected to provide a gate which can be opened to position the assembly around the pipe, and closed to cause the members to grip the pipe. An opening and closing means for the gate includes a rod pivotally secured to one of the adjacent gripping members and carrying a piston on its outer end. A cylinder receives the piston with the rod extending through the inner end thereof, and a thrust member is mounted outside the inner end of the cylinder. The thrust member is shaped to abut outer surfaces of a pair of latch arms that are pivotally connected to the other of the adjacent gripping members. Pressure connections are provided on the cylinder to communicate with the respective regions on opposite sides of the piston. A relatively low pressure is applied continuously to the outer face of the piston to produce an actuating force that tends to move the cylinder and the thrust member away from the latch arms and open the gate. Relatively high pressure is selectively applied to the inner face of the piston and the inner end of the cylinder to produce a resultant force that tends to close the apparatus. As this last-mentioned pressure is reduced, eventually the opening pressure will predominate so that the latch automatically opens. The pressures can be applied from a remote control station so that the apparatus is operated without anyone being near the clamp during closing and opening thereof. A new and improved method of operating a pipe handling clamp also is within the scope of this invention.

BRIEF DESCRIPTION OF THE DRAWINGS

The present invention has other objects, features and advantages that will become more clearly apparent in connection with the following detailed description of a preferred embodiment, taken in connection with the appended drawings in which:

FIG. 1 is a top one-half view of the clamp apparatus of the present invention;

FIG. 2 is a cross-sectional view on line 2—2 of FIG. 1; and

FIG. 3 is side view of the clamp apparatus of the present invention.

DETAILED DESCRIPTION OF A PREFERRED EMBODIMENT

Referring initially to FIG. 1, a pipe handling clamp assembly 10 that is constructed in accordance with this invention includes a generally circular series of carrier bodies 11 on which slip segments 20 are mounted. The carrier bodies 11 are mounted on pairs of upper and lower links 12,13 that are coupled by pivot pins 14 in a chain-like manner. As shown in FIGS. 1 and 2, each carrier body 11 has a T-shaped slot 16 that is formed longitudinally of its inner side, and a companion configuration 17 on the back side of each slip segment 20 fits into the slot in a manner such that the slip segment can move vertically to a limited extent. Upward movement of each slip segment 20 with respect to its carrier body 11 is limited by a pin 21 that extends across the top of the slip, and downward movement is limited by engagement with a shoulder 21 below the slip segment. Another pin 23, such as a colter pin, is provided to connect the rear portion 19 of each body 11 to the mid-portion of a respective pair of links 12,13 in a manner such that a limited amount of angular play is possible. This enables the slip segments 20 to conform to the shape of the pipe 9 and fit closely against its outer surface.

Each slip element 20 has vertically spaced, upwardly facing serrations or teeth 26 on its inner surface that can bite into and grip the outer surface of the pipe 9. A rear surface portion 24 of each slip segment 20 is inclined downward and inward, and cooperates with a companion inclined surface 24' on the carrier body 11 to provide a self-tightening effect in response to opposite relative movement. Suitable handles (not shown) can be used in place of an adjacent pair of the pins 14 on each side of the assembly 10 to provide a means by which the clamp assembly and the pipe can be elevated. In the event the pipe 9 is being snubbed into a well under pressure, the assembly is inverted and pulled downward.

A gate region 23 as shown in FIG. 1 is provided between the two adjacent carrier bodies 22,22'. The right side carrier body 22 is mounted on a pair of links 28, and the left side carrier body 22' is mounted on a pair of latch arms 25,25'. The links 28 are connected by a pin 36 to an eye coupler 37 on the outer end of an elongated piston rod 30. A thrust member 32 having a convex curved outer surface 33 is mounted on the rod 30 adjacent the cylinder head 61, and its outer surface is shaped to engage the concave curved surfaces 34 on the outer sides of the latch arms 35,35'. The thrust member 32 is generally rectangular in shape, and can be a separate piece that is slidable relative along the rod 30, or it can be rigidly attached to the cylinder head 61. The outer wall 41 of the thrust member 32 is planar, and is arranged to engage the outer wall of the inner cylinder head 61 of an assembly indicated generally at 43.

The cylinder assembly 43 includes a tubular barrel 44 having the head 61 secured its inner end and its outer end secured to a cylinder head 62. A piston 46 that is connected to the outer end of the rod 30 carries seal rings 47 and works in the barrel 44 in a manner such that the interior of the cylinder is divided into an outer region 50 and an inner region 51. The region 50 is communicated to a source of air under pressure by a port and connection 52, and the inner region 51 is communicated with a source of hydraulic fluid and pressure by a port and connection 53. A three-way valve 54 can have the outlet connected to the port 53 to control the direction of fluid flow, having an inlet, a discharge, and an outlet.

For use in carrying the clamp assembly 10, a handle indicated generally at 70 in FIG. 3 can be provided. The handle 70 includes a tubular hand grip 71 having transverse walls 72,73 at its opposite ends. The walls 72,73 have depending legs 74,75 that are fixed to the opposite sides of the respective cylinder heads 61,62 by cap screws or the like. If desired, the handle 70 can be made shorter and extend from the outer head 62 to a point on the barrel 44 short of the inner head 61 for convenience in making pressure connections.

Operation

In use, the clamp assembly 10 is positioned around the pipe with the rod 30 and the cylinder 43 swung outward to the open position, and then these elements are pivoted inward to the closed position where the thrust member 32 and the cylinder are generally aligned with the thrust surfaces 30 of the latch arms 25,25'. The pressure connection 53 is connected by a line to the control valve 54, and the region 50 is pressurized to a proper low pressure level by a suitable source. Either air or nitrogen can be used, and is pressurized to a relatively low value, for example about 20–50 psi, such pressure generates a constant force equal to that pressure times the cross-sectioned area of the piston 46 which tends to move the barrel 42 and the rod 30 in opposite directions to open the assembly, and hold it open. When the gate closure is latched, hydraulic pressure, for example up to about 1,500 psi, is applied to the region 51 which creates a net closing force that is the product of the hydraulic pressure and the difference in cross-sectional areas of the piston 46 and the rod 30, minus the opening force due to air or nitrogen pressure acting on the outer face of the piston 46. With the thrust member 32 engaging the surfaces 34 of the latch arms 25,25' the resultant closing force drives the cylinder 43 and the thrust member 32 inward while pulling the rod 30 outward. This pulls the slip segments 20 tightly against the outer surface of the pipe 9.

To release the clamp assembly 10, the valve 54 is opened to bleed off hydraulic pressure from the region 51. At a point shortly prior to the time the hydraulic pressure is completely bled off, the pneumatic pressure in the region 50 will predominate, and the cylinder head 41 and the thrust member 32 will automatically be moved out of engagement with the latch arms 25,25' so that the gate area 23 of the assembly 10 can be opened by swinging the cylinder assembly 43 and the thrust member 32 outward of the latch arms.

For certain offshore applications, it is considered to be preferable to pressurize the region 50 with nitrogen, in accordance with applicable safety regulations. However, the overall operation using nitrogen is essentially the same as when using air.

The present invention has numerous advantages over the mechanical device mentioned above. The cylinder assembly 43 does not require manual tightening using a wrench and sledge hammer. The invention operates faster and thus saves rig time. It is considerably safer to use and no tools are required on the rig floor which could be dropped down hole. The cylinder assembly 43 applies the same holding torque each time it is used, and less torque can be applied, if desired, by reducing the hydraulic pressure in the region 51.

It now will be recognized that a new and improved pipe handling apparatus and method have been disclosed. Since certain changes or modifications can be made in the disclosed embodiment without departing from the inventive concepts involved, it is the aim of the following claims to cover all such changes and modifications that fall within the true spirit and scope of the present invention.

What is claimed is:

1. Apparatus adapted to be clamped around a pipe to enable handling the same, comprising: a clamp assembly including a plurality of circumferentially spaced slip means; link means for pivotally connecting said slip means together, an adjacent pair of said slip means being disconnected to provide a gate region that when open allows the assembly to be positioned around the pipe; means for opening and closing means said gate region including piston and cylinder means, one of said piston and cylinder means being pivotally connected to one of said adjacent slip means and the other of said piston and cylinder means being releasably attached to the other of said adjacent slip means, and means for applying selected pressures to the opposite faces of said piston means to close and open said gate region.

2. The apparatus of claim 1 wherein said piston means is pivotally connected to said one slip means and said cylinder means is arranged for releasable latching with respect to said other adjacent slip means.

3. The apparatus of claim 2 further including latch arm means on said other slip means and abutment means on said cylinder means arranged to engage said arm means to close said gate region.

4. The apparatus of claim 3 wherein said arm means includes a pair of latch members facing said abutment means, said abutment means comprising a thrust member having convex surfaces thereon, said latch members having concave surfaces arranged to be engaged by said convex surfaces as axial thrust forces are applied thereto.

5. The apparatus of claim 4 wherein said abutment means is slidable relative along said piston means.

6. The apparatus of claim 1 wherein said piston and cylinder means includes a rod extending through an end of said cylinder means, and piston means on said rod positioned in said cylinder means; and wherein said applying means comprises first means for applying selected pressures to one side of said piston, and second means for applying a substantially constant pressure to the other side of said piston means.

7. The apparatus of claim 6 wherein said pressures on said one side tend to retract said piston and cylinder means and develop closing forces and the pressure on said other side of said piston means tends to extend said piston and cylinder means and thereby open said gate region.

8. The apparatus of claim 7 further including means for applying a substantially constant, low level pressure to said other side while applying a greater, high level pressure to said one side.

9. The apparatus of claim 8 further including latch arm means of said other of said adjacent slip means; and abutment means on said cylinder means arranged to move into engagement with said latch arm means and apply thrust forces thereto, said abutment means being arranged to move axially away from said latch arm means when said high level pressure is reduced to a value such that said low level pressure predominates.

10. A method of clamping a pipe to enable handling the same with a clamp assembly that includes linked gripping elements encircling the pipe and a gate region between an adjacent pair of said gripping elements that permits the assembly to be positioned around the pipe and to be removed therefrom, comprising the steps of: providing differential pressure operated piston and cylinder means to close and open said gate region; pivotally coupling said piston means to one of said adjacent gripping elements to enable opening and closing said gate region; latching said piston and cylinder means to the other of said adjacent gripping elements to close said gate region; subjecting one side of said piston means to a first pressure; subjecting the other side of said piston means to a second pressure that is greater than said first pressure to force said adjacent gripping elements relative toward one another; releasing said second pressure; and automatically unlatching said piston and cylinder means in response to said first pressure.

11. The method of claim 10 wherein said first pressure is in the range of 20–50 psi.

12. The method of claim 11 wherein said first pressure is in the range of 20–50 psi.

13. The method of claim 10 where said second pressure is about 1,500 psi.

* * * * *